US010866071B2

(12) United States Patent
Huang

(10) Patent No.: US 10,866,071 B2
(45) Date of Patent: Dec. 15, 2020

(54) SHOOTING TRAINING SYSTEM

(71) Applicant: OASIS PARTNERS IP HOLDINGS, LLC, Glen Rock, PA (US)

(72) Inventor: John Huang, Glen Rock, PA (US)

(73) Assignee: OASIS PARTNERS IP HOLDINGS, LLC, Glen Rock, PA (US)

( * ) Notice: Subject to any disclaimer, the term of this patent is extended or adjusted under 35 U.S.C. 154(b) by 168 days.

(21) Appl. No.: 15/866,515

(22) Filed: Jan. 10, 2018

(65) Prior Publication Data

US 2018/0202776 A1 Jul. 19, 2018

Related U.S. Application Data

(60) Provisional application No. 62/446,381, filed on Jan. 14, 2017.

(51) Int. Cl.
*F41J 5/14* (2006.01)
*F41J 9/04* (2006.01)
(Continued)

(52) U.S. Cl.
CPC ..... *F41J 5/14* (2013.01); *F41G 3/26* (2013.01); *F41J 1/10* (2013.01); *F41J 5/00* (2013.01); *F41J 5/06* (2013.01); *F41J 5/12* (2013.01); *F41J 5/24* (2013.01); *F41J 7/00* (2013.01); *F41J 9/00* (2013.01); *F41J 9/02* (2013.01); *F41J 9/04* (2013.01); *A63B 2024/004* (2013.01)

(58) Field of Classification Search
None
See application file for complete search history.

(56) References Cited

U.S. PATENT DOCUMENTS 5,069,399 A * 12/1991 Robinson ..... F41J 9/10 244/1 TD
5,349,853 A 9/1994 Oehler
(Continued)

OTHER PUBLICATIONS

Marathon Targets, "Marathon Targets robotic targets for live-fire training," http://marathon-targets.com/, (c) 2015, Accessed Dec. 11, 2017.

(Continued)

*Primary Examiner* — Jason T Yen
(74) *Attorney, Agent, or Firm* — Bennet K. Langlotz; Langlotz Patent & Trademark Works, Inc.

(57) ABSTRACT

Shooting training systems have a self-propelled robotic target support platform operable to navigate on an extended surface, the platform supporting a target, the platform including a sensor array adapted to detect and register shot information about a shot generated by a shooter passing proximate the target, a transmitter on the platform adapted to transmit the shot information, and a receiver associated with the shooter adapted to receive the shot information and to provide shot information to the shooter. The platform may be a vehicle adapted to operate over a ground surface in any direction. The platform may be a watercraft. The platform may be a wheeled vehicle. The sensor array may be adapted to detect and register shot information including a location and direction of the shot. There may be a plurality of robotic target support platforms, each having a sensor array. The receiver may be adjacent to the shooter.

22 Claims, 7 Drawing Sheets

(51) Int. Cl.

| | |
|---|---|
| ***F41J 9/02*** | (2006.01) |
| ***F41J 1/10*** | (2006.01) |
| ***F41J 9/00*** | (2006.01) |
| ***F41J 5/24*** | (2006.01) |
| ***F41J 5/06*** | (2006.01) |
| ***F41J 5/00*** | (2006.01) |
| ***F41J 5/12*** | (2006.01) |
| ***F41J 7/00*** | (2006.01) |
| ***F41G 3/26*** | (2006.01) |
| *A63B 24/00* | (2006.01) |

(56) References Cited

U.S. PATENT DOCUMENTS

| | | | | |
|---|---|---|---|---|
| 8,006,981 | B2 | 8/2011 | Gibson | |
| 9,817,015 | B2 | 11/2017 | Oehler | |
| 2012/0208150 | A1* | 8/2012 | Spychaiski | F41H 7/005 434/20 |
| 2015/0123346 | A1* | 5/2015 | Mason | F41J 1/10 273/371 |
| 2016/0370156 | A1 | 12/2016 | Elizondo et al. | |
| 2017/0343326 | A1* | 11/2017 | Weiland | F41J 5/056 |
| 2018/0299233 | A1* | 10/2018 | Brooks | F41J 9/02 |

OTHER PUBLICATIONS

Raytheon Company, "Boomerang III," https://www.raytheon.com/capabilities/products/boomerang/, (c) 2017, Accessed Dec. 11, 2017.
Raytheon Company, "Boomerang Warrior-X," https://www.raytheon.com/capabilities/products/boomerang_warriorx/, (c) 2017, Accessed Dec. 11, 2017.

* cited by examiner

SHOOTING TRAINING SYSTEM

CROSS-REFERENCE TO RELATED APPLICATION

This application claims the benefit of U.S. Provisional Patent Application No. 62/446,381 filed on Jan. 14, 2017, entitled "MOVING TARGET WITH HEMISPHERICAL DETECTION AND CALCULATION OF SUPERSONIC PROJECTILES," which is hereby incorporated by reference in its entirety for all that is taught and disclosed therein.

FIELD OF THE INVENTION

The present invention relates to firearms, and more particularly to a shooting training system that includes a self-propelled target that can detect and register shot information about a shot generated by a shooter passing proximate the target.

BACKGROUND OF THE INVENTION

Live-fire target practice with small arms is typically conducted on training ranges with one-directional courses of fire. Historically, training participants line up along a firing line and shoot their weapons, all aimed in the same direction, towards static targets arranged along a target line. In the case of paper, cardboard, or similar consumable targets, the targets must be visually inspected after firing ceases to determine where hits were made. Usually, this means ceasing fire on the shooting range and walking down to the target to inspect and replace the used target. Steel targets provide relatively immediate audible, and to some extent, visual, feedback when hit by a projectile. However, at longer distances and with several shooters and multiple targets, it can be difficult to accurately detect hits on specific targets.

Some shooting ranges offer moving targets. These moving targets are typically mounted on some form of a track and move from side to side, either via a cable/pulley arrangement, or some mode of self-propulsion. These moving targets are usually mobile versions of static targets—paper, cardboard or steel shapes that provide an indication of where the target was hit.

Although the numerous conventional static and moving targets available are generally suitable for their intended use, they suffer from numerous disadvantages. Traditional targets give no indication as to whether and where the target was missed. Traditional targets do not reliably give immediate feedback on the location of hits. Traditional targets expose shooters and range personnel to potentially unsafe conditions because of a regular need to go downrange to inspect and change consumable targets. Traditional moving targets usually move along a perpendicular path horizontal to the shooter, which does not accurately represent movement of real life targets. Moving targets that move towards the shooter are still generally constrained to move in a single direction via a track system. Traditional moving targets usually require a flat surface, such as a concrete pad, for mounting of the track system.

To provide more realistic shooting training, robotic targets, such as those manufactured by Marathon Targets of Sydney, Australia, have been developed. These robotic targets can move in any direction on a ground surface and react to being hit being a bullet. However, they lack the ability to detect misses, and they are unable to determine where a hit originated from to inform their reaction.

Shot detection systems, such as the Boomerang III and Boomerang Warrior-X manufactured by Raytheon Company of Waltham, Mass., use passive acoustic detection to locate a shooter when a shot is detected. These systems are mounted on vehicles or worn by individual soldiers. However, they provide feedback to the soldiers being shot at, not the shooter.

Therefore, a need exists for a new and improved shooting training system that is a self-propelled target that can detect and register shot information about a shot generated by a bullet or other projectile passing proximate the target. In this regard, the various embodiments of the present invention substantially fulfill at least some of these needs. In this respect, the shooting training system according to the present invention substantially departs from the conventional concepts and designs of the prior art, and in doing so provides an apparatus primarily developed for the purpose of enabling the user to experience shooting at a target that can move in multiple directions and headings and that provides immediate feedback on the locations of hits and misses.

SUMMARY OF THE INVENTION

The present invention provides an improved shooting training system, and overcomes the above-mentioned disadvantages and drawbacks of the prior art. As such, the general purpose of the present invention, which will be described subsequently in greater detail, is to provide an improved shooting training system that has all the advantages of the prior art mentioned above.

To attain this, the preferred embodiment of the present invention essentially comprises a self-propelled robotic target support platform operable to navigate on an extended surface, the platform supporting a target, the platform including a sensor array adapted to detect and register shot information about a shot generated by a shooter passing proximate the target, a transmitter on the platform adapted to transmit the shot information, and a receiver associated with the shooter adapted to receive the shot information and to provide shot information to the shooter. The platform may be a vehicle adapted to operate over a ground surface in any direction. The platform may be a watercraft. The platform may be a wheeled vehicle. The sensor array may be adapted to detect and register shot information including a location and direction of the shot. There may be a plurality of robotic target support platforms, each having a sensor array. The receiver may be adjacent to the shooter. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
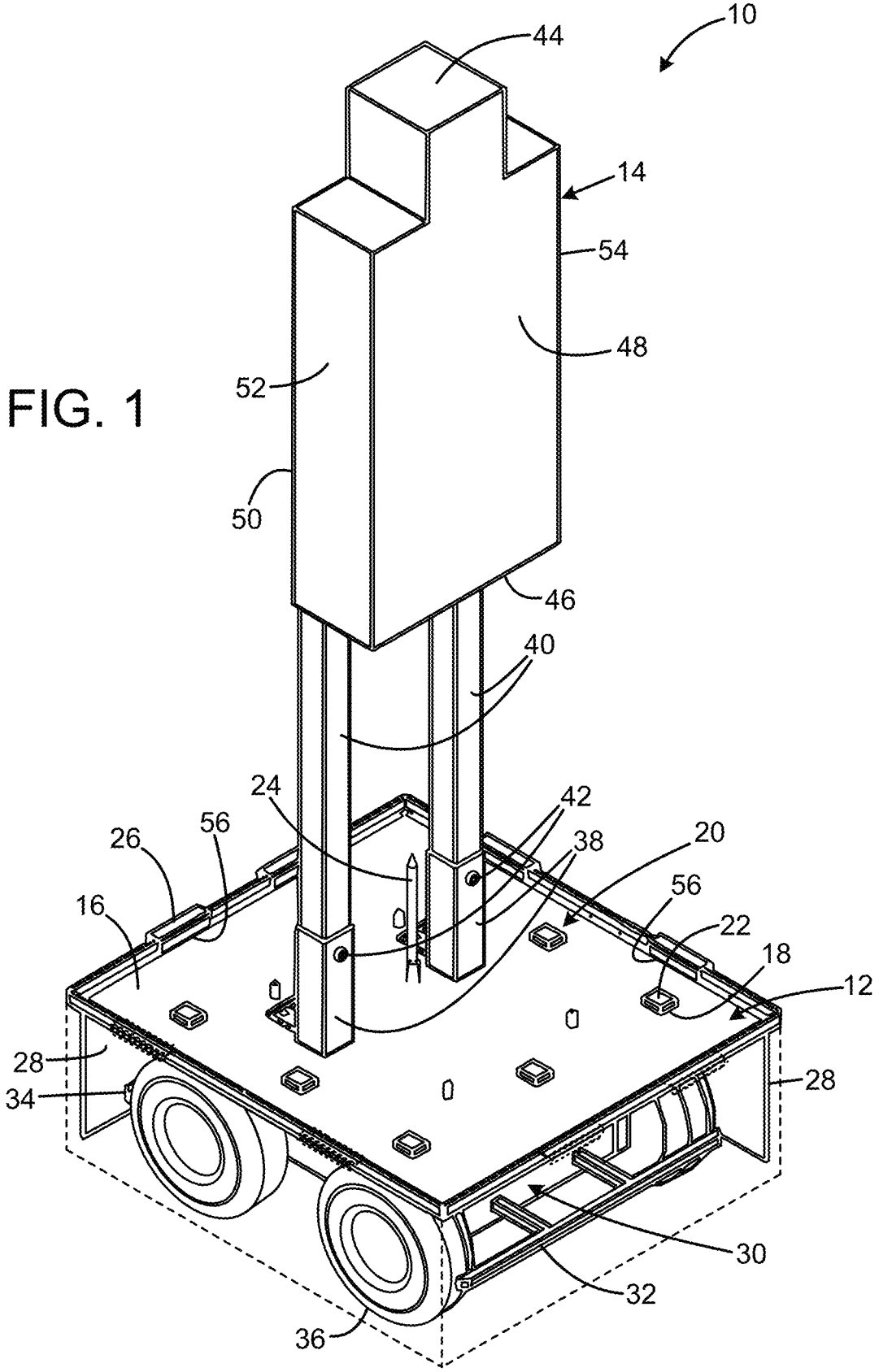
FIG. 1 is a front isometric view of the current embodiment of the shooting training system constructed in accordance with the principles of the present invention.

An embodiment of the shooting training system of the present invention is shown and generally designated by the reference numeral 10.

Figure 2:
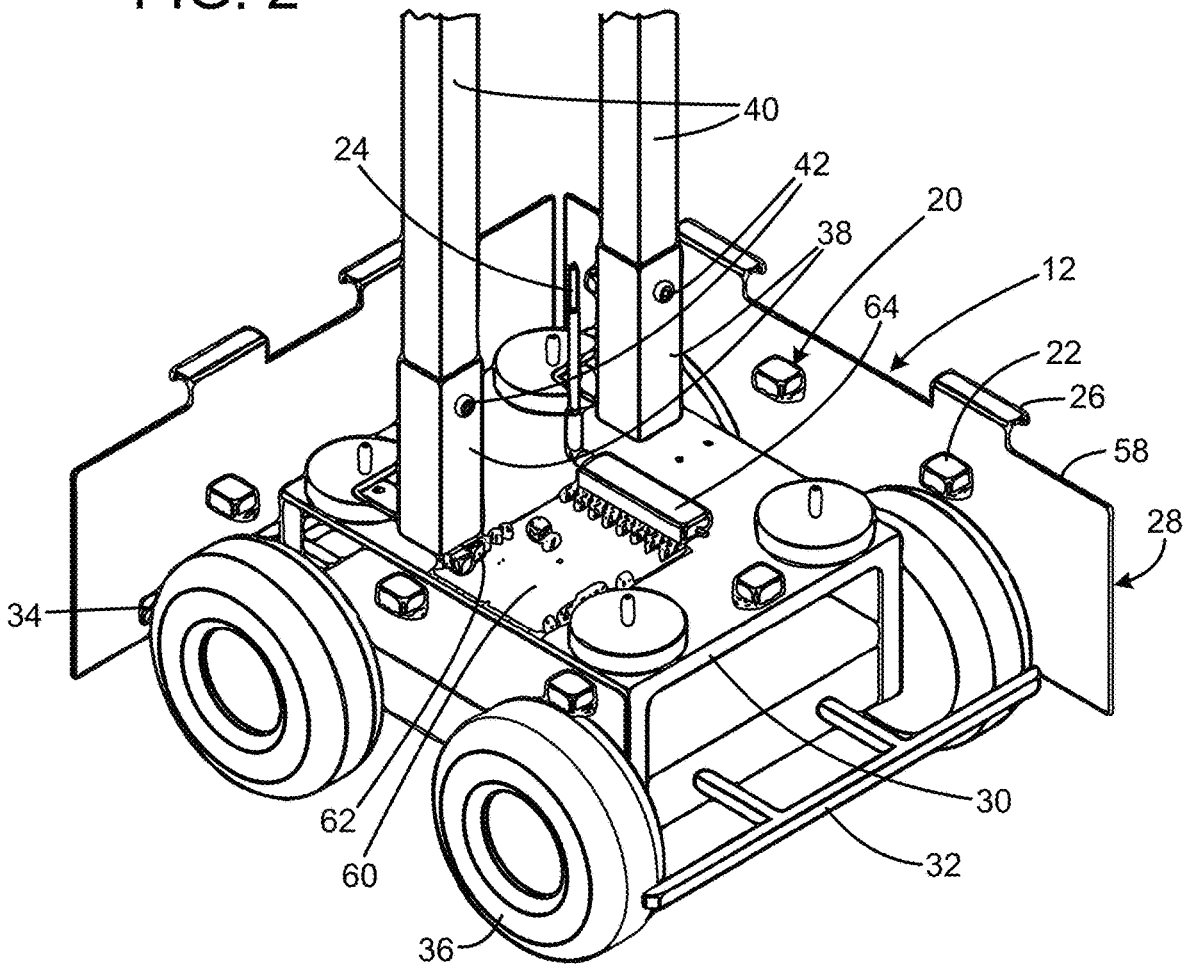
FIG. 2 is a front isometric view of the electronics of the current embodiment of the shooting training system of FIG. 1.

FIGS. 1 and 2 illustrate the improved shooting training system 10 of the present invention. More particularly, the shooting training system has a target-bearing mobile platform 12 supporting a target 14. The platform has a top plate 16 that defines a plurality of apertures 18 and slots 56. A sensor array 20 in the form of a plurality of sensors 22 extends upward through the apertures. An antenna 24 also extends upward through the top plate. Four skirt plates 28 are fastened by their tops 58 to the top plate by bent tabs 26 that pass through the slots in the top plate. The top plate and skirt plates collectively form a shell of armor plate in the current embodiment that covers and protects an interior frame 30 and its attached components from bullet strikes. The interior frame has a forwardly extending front brace 32, a rearwardly protruding rear brace 34, and four wheels 36. In the current embodiment, the skirt plates are loosely fastened to the top plate by the bent tabs. This enables the plates to be lighter in weight compared to solidly mounted armor plates because some of the energy from an impacting bullet is converted to plate movement. In the current embodiment, the platform is a wheeled vehicle adapted to operate over a ground surface in any direction.

Two support leg braces 38 protrude vertically from the top plate 16. Each support leg brace receives one end of a support leg 40. The support legs are removably fastened within the support leg braces by bolts 42. The target 14 is supported above the platform 12 by the support legs. The target has a top 44, bottom 46, front 48, rear 50, right side 52, and left side 54. In the current embodiment, the target is a three-dimensional silhouette that roughly approximates a human shape. The target is supported by its bottom in a vertical orientation relative to the platform 12.

In FIG. 2, the top plate 16 and two of the skirt plates 28 are cut away to expose the interior frame 30 and its attached components. More particularly, a circuit board 60 has electronics 62 including a data radio transmitter 64 attached to the antenna 24. The electronics include a processor operably connected to the platform 12. The circuit board is also electrically connected to the sensor array 20. In the current embodiment, the sensor array is an array of acoustic sensors that, in combination with the circuit board with electronics, makes an electronic system that detects the passage of a bullet or other projectile, computes the trajectory of the bullet, and determines where the bullet hits or misses the target 14. The sensor array has a hemispherical detection capability so that bullets coming from any direction that hit or miss the target can be detected and their resulting trajectories can be computed. The sensor array is adapted to detect and register shot information including a location and direction of the shot, as well as any deviation of a shot from a desired target point. In the current embodiment, the hemispherical detection capability has a maximum detection range of more than 10 meters, depending on the size and velocity of the projectile, relative to the exterior surfaces of the target. Fast, large projectiles moving at Mach 3 can be detected at upwards of 20 meters away.

Figure 3:
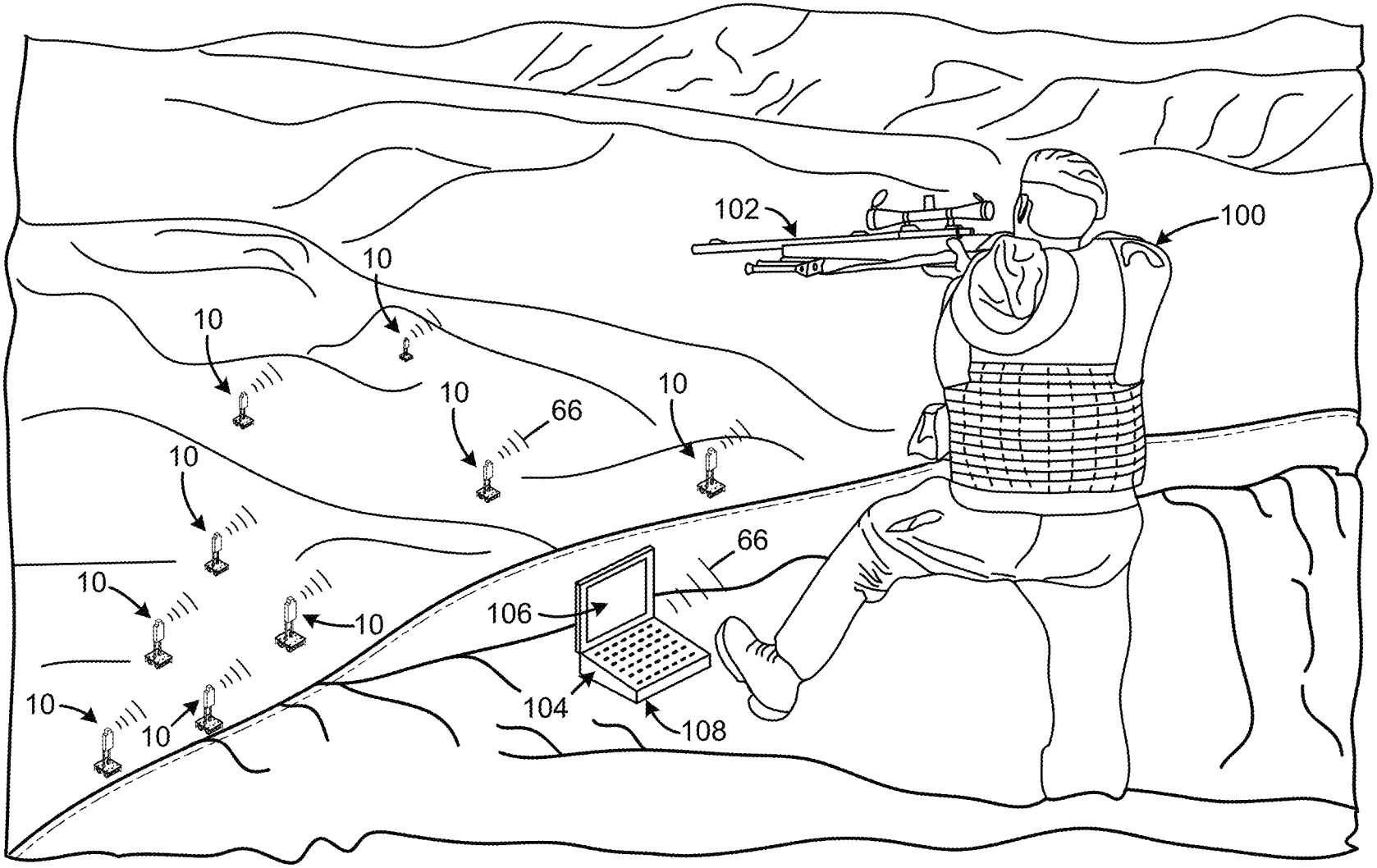
FIG. 3 is a front isometric view of the current embodiment of the shooting training system of FIG. 1 in use in a live-fire training exercise.

FIG. 3 illustrates the improved shooting training system 10 in use in a live-fire training exercise. More particularly, a shooter 100 training with a rifle 102 is confronted with a plurality of the robotic target support platforms 12 that form the shooting training system 10. Each of the robotic target support platforms has a sensor array 20, circuit board 60, electronics 62, and data radio transmitter 64. Shot information about each shot passing within the hemispherical detection capability of each platform is transmitted by the associated data radio transmitter and antenna 24 using radio waves 66 to a receiver 104. Receiver 104 positioned adjacent to the shooter in the current embodiment can receive the radio waves and use the shot information communicated by the radio waves to present data to the shooter via display 106. The receiver also has one or more human interface devices 108, such as a keyboard, touchpad, or touchscreen that enable the shooter to interact with the display.

Figure 4:
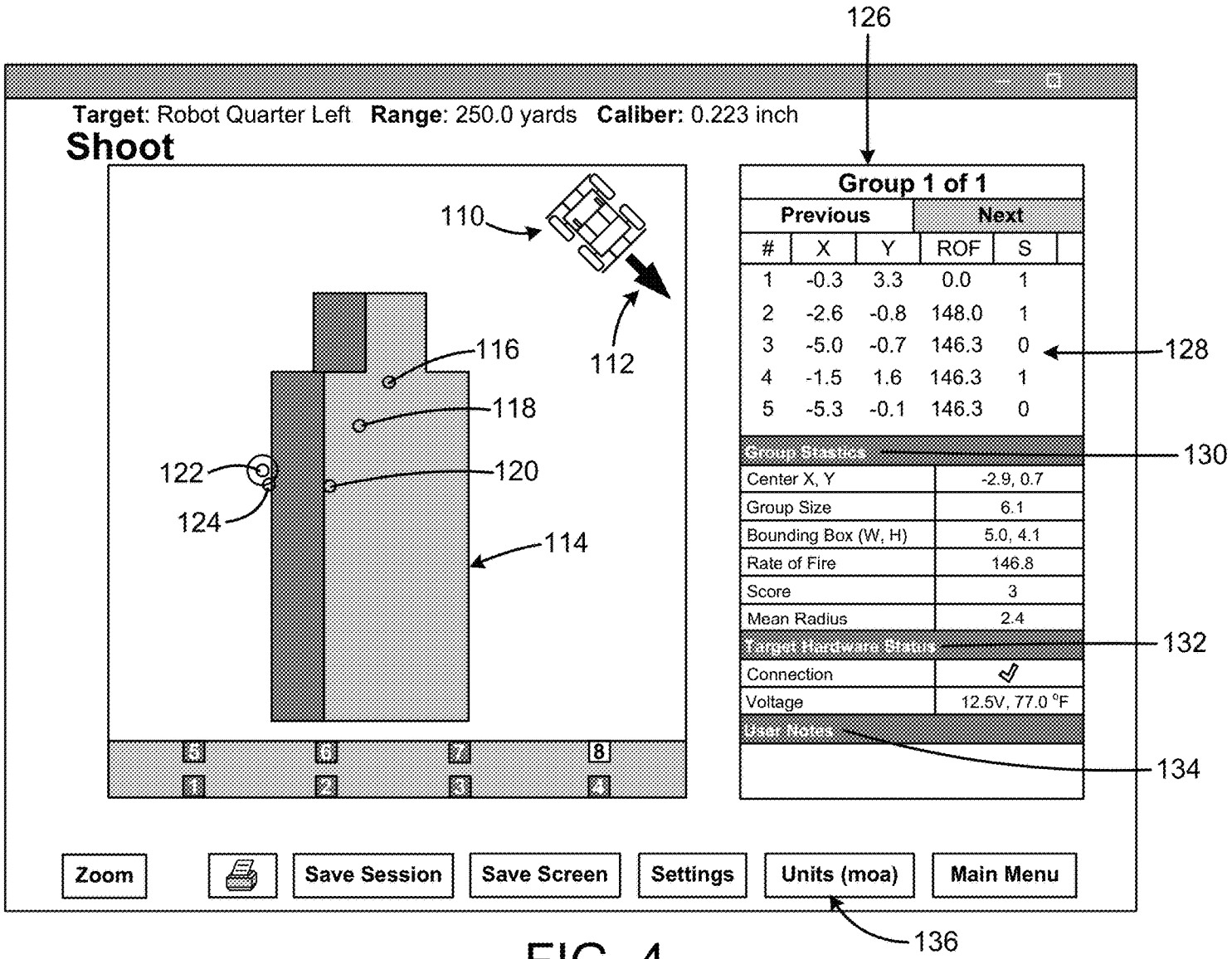
FIG. 4 is a screen capture from a display of a user interface of the current embodiment of the shooting training system of FIG. 1.

FIG. 4 is a screen capture from the display 106 of the shooting training system 10. More particularly, the display shows a user interface that the shooter 100 can interact with during and after a live-fire training exercise. Using the shot information communicated by each platform 12, the display can show the current orientation 110 of a platform relative to the shooter, the direction of movement 112 of the platform relative to the shooter, a target representation 114 oriented relative to the shooter, and any hits 116, 118, 120 and any misses 122, 124 detected by the sensor array 20 of the platform. A shot data window 126 can present individual shot data 128, group statistics 130, target hardware status 132, and user notes 134. The display can also show function buttons 136 that enable the shooter to save information regarding the live-fire training exercise and change the nature of the data presented by the display.

At the bottom of the target window, there are six indicators numbered 1 through 8, corresponding to sensors on the target. These indicators show the status of each sensor when a shot is detected. If the screen capture were shown in color, green indicators would correspond to the sensors that were triggered during a shot. Those sensors not triggered by the shot would be shown in red. In the screen capture shown in FIG. 4, the triggered sensors are shown as white numbers on a dark background. The sensor that was not triggered is shown as a dark number on a white background.

In use, one or more moving platforms 12 with targets 14 are placed downrange from the training participants/shooters 100 and are set in motion. The sensor array 20 of each platform constantly operates listening for the passage of a bullet or other projectile. As a bullet passes through or near the platform's target, each sensor 22 responds when triggered by the passage of the bullet's supersonic shockwave. As each sensor is triggered, the electronics 62 of the platform under fire assign a timestamp to each sensor's channel. When enough sensors are triggered, and the corresponding channels are timed, the electronics broadcast an event with a timestamp for each channel along with other data collected at the time of the event, such as air temperature, via the data radio transmitter 64.

A receiver 104 is typically located beside or near the training participants/shooters 100 and remotely located from the moving platform 12 with target 14. In the current embodiment, the receiver is a computer containing specialized software receives the shot event data from the moving platform via radio waves 66. The software is configured to be aware of the sensor arrangement in the sensor array 20, including coordinate locations of each sensor 22. The software uses the combination of sensor coordinates, timestamps, and air temperature to calculate the trajectory of the bullet relative to the target. The software then determines how the target was positioned relative to the shooter when the bullet was detected. The software subsequently presents a graphical view of the target on the display 106 that matches the orientation the shooter would have seen. The position of the bullet relative to the oriented target is then graphically displayed on the computer's display screen to show a hit or a miss.

After determining the location of a hit or a miss on the target 14, the receiver 104 transmits shot information in the form of the location of bullet hit or miss to the relevant moving platform 12 with target 14 via radio waves 66. Upon receipt of the shot information, the electronics 62 including the processor are adapted to generate motion of the platform in response to the shot information about a shot generated by a shooter 100 passing proximate or hitting the target. By reacting to misses as well as hits, the moving platform with target responds in a much more realistic way to create a more effective life-fire training exercise. In response to the shot data, the moving platform with target can simulate running away from the shot, charging towards the shot, or any other desired offensive or defensive maneuver in any direction to provide the most effective simulation.

Figure 5:
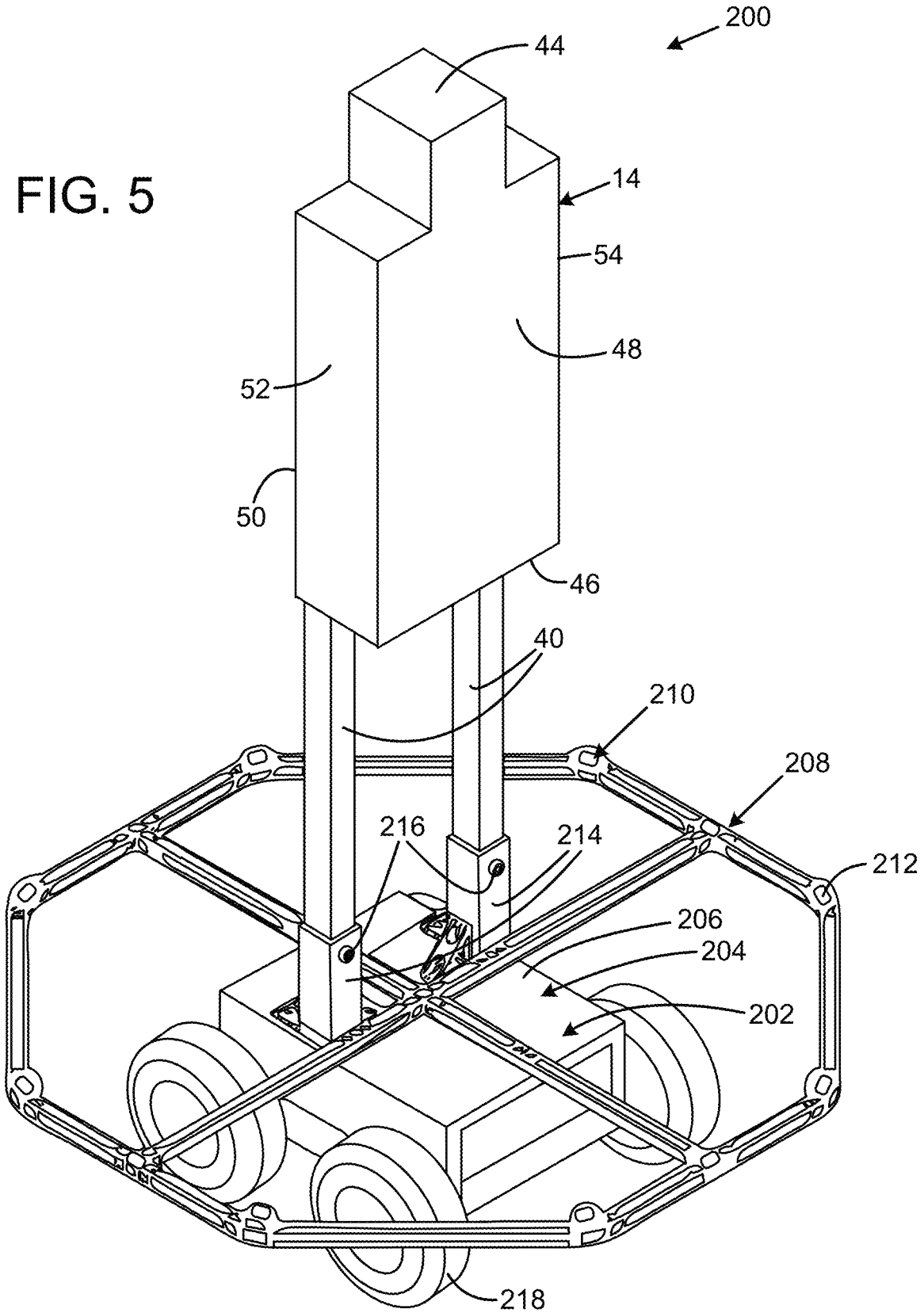
FIG. 5 is a front isometric view of a first alternative embodiment of the shooting training system of the present invention.

FIG. 5 illustrates a first alternative embodiment 200 of the shooting training system. More particularly, the first alternative embodiment has a platform 202 including an interior frame 204 having a top 206 and wheels 218. A sensor frame 208 is attached to the top of the interior frame. The sensor frame includes a sensor array 210 consisting of a plurality of sensors 212. In this embodiment, eight sensors are used to form the sensor array, and the sensors are arranged in a ring shape by the sensor frame. The sensor arrangement can be variable, but ideally consists of at least six sensors. Although there is no theoretical limitation on the number of sensors used, optimal trajectory computations can be made using between eight and 16 sensors. The platform 202 has support leg braces 214 that receive one end of support legs 40 to support a target 14. The support legs are releasably secured within the leg braces by bolts 216.

Figure 6:
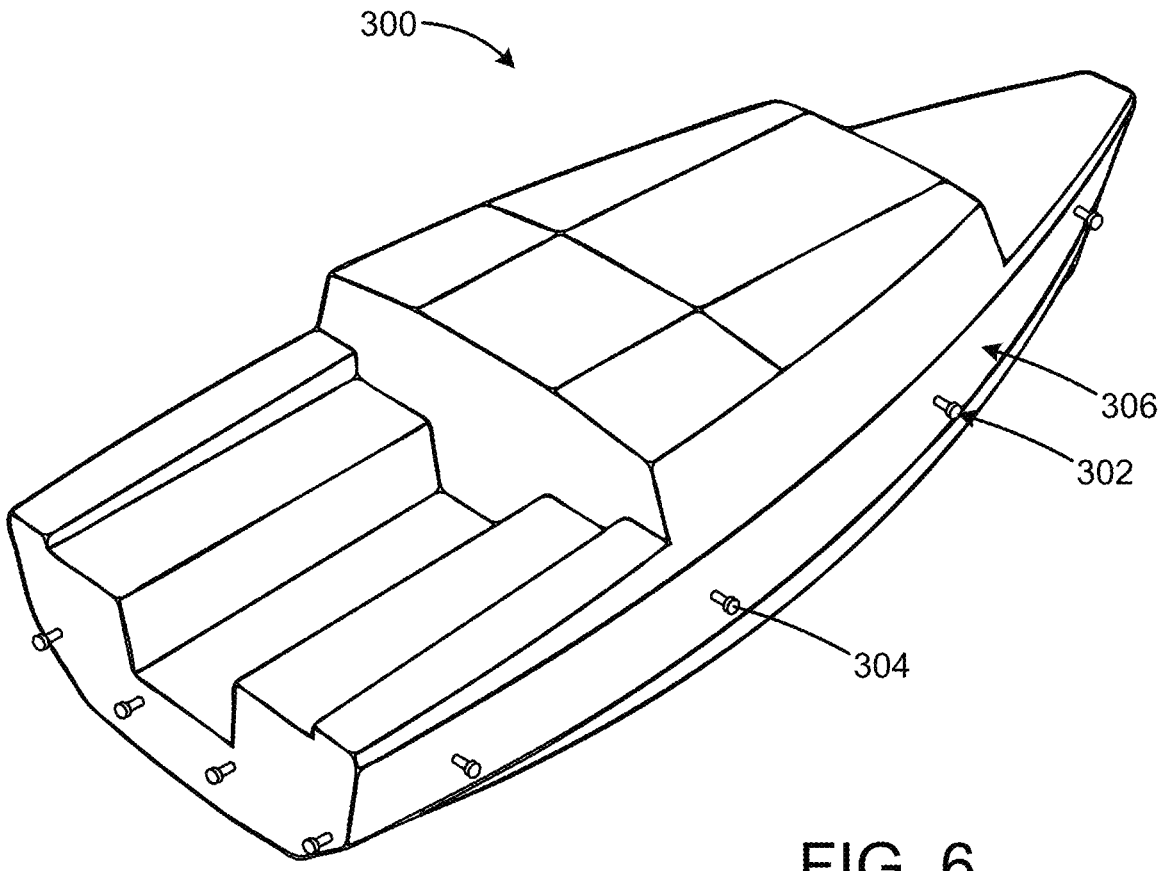
FIG. 6 is a rear isometric view of a second alternative embodiment of the shooting training system of the present invention.

FIG. 6 illustrates a second alternative embodiment 300 of the shooting training system. More particularly, the second alternative embodiment is a watercraft that serves as both the moving platform and the target. The watercraft includes a sensor array 302 in the form of a plurality of sensors 304 deployed about the perimeter 306 of the watercraft. The watercraft includes electronics (not visible) and is self-propelled. As a result, the watercraft can communicate shot data to a receiver 104 and receive shot information about the locations of hits and misses to simulate realistic responses to being fired upon.

Figure 7:
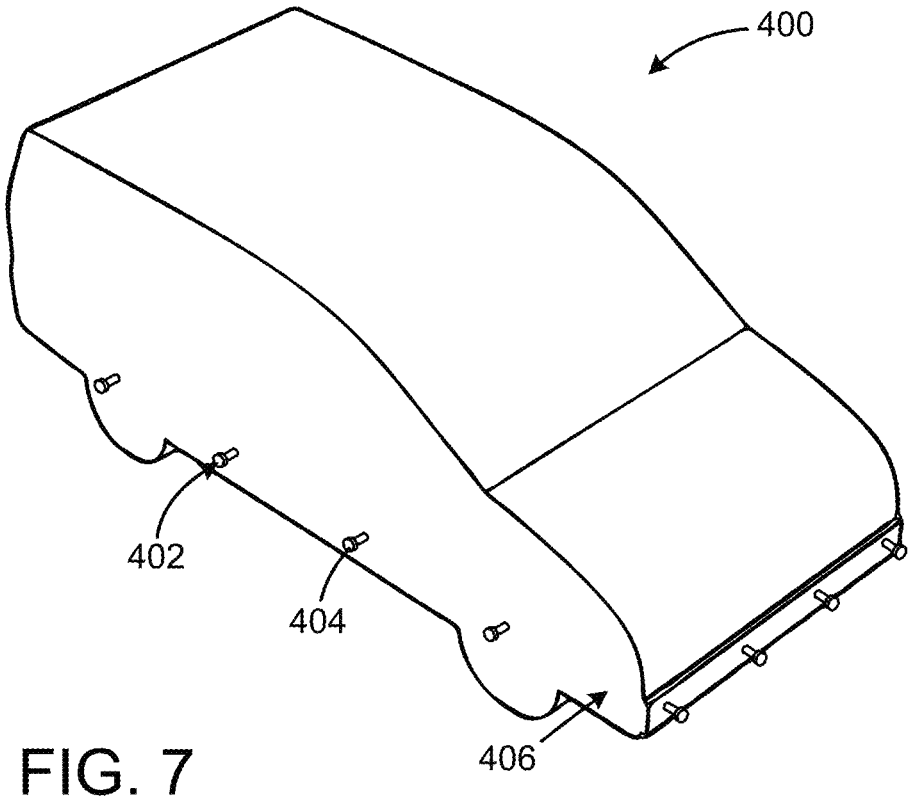
FIG. 7 is a front isometric view of a third alternative embodiment of the shooting training system of the present invention.

FIG. 7 illustrates a third alternative embodiment 400 of the shooting training system. More particularly, the third alternative embodiment is a wheeled vehicle that serves as both the moving platform and the target. The wheeled vehicle includes a sensor array 402 in the form of a plurality of sensors 404 deployed about the perimeter 406 of the wheeled vehicle. The wheeled vehicle includes electronics (not visible) and is self-propelled. As a result, the wheeled vehicle can communicate shot data to a receiver 104 and receive shot information about the locations of hits and misses to simulate realistic responses to being fired upon. Furthermore, although a wheeled vehicle is illustrated, any form of vehicle could be used, including tracked vehicles and hovercrafts.

In the context of the specification, the term "robotic" has the following definition: a machine capable of carrying out a complex series of actions automatically, especially one programmable by a computer.

While current embodiments of a shooting training system have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, although a self-propelled target has been disclosed, it should be appreciated that the target could be pulled by another vehicle. Furthermore, although a human-shaped target has been disclosed, the target can be any shape, including an abstract or geometric shape, an animal shape, and the shape of an inanimate object, such as a vehicle. Finally, it should be appreciated that the software that calculates the trajectory can also be located on the target. Specifically, the circuit board 60 can be configured to perform the calculations.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shooting training system comprising:

a self-propelled robotic target support platform operable to navigate on an extended surface;

the self-propelled robotic target support platform supporting a target;

the self-propelled robotic target support platform including a sensor array adapted to detect and register shot information about a shot generated by a shooter and passing proximate the target, but not striking the target, the shot information including information about the location of the shot;

a transmitter on the self-propelled robotic target support platform adapted to transmit the shot information;

a receiver associated with the shooter adapted to receive the shot information and to provide shot information to the shooter; and including a processor operably connected to the platform and adapted to generate motion on the platform in response to the shot information, the motion of the platform being in a direction based on the location of the shot.

2. The shooting training system of claim 1 wherein the self-propelled robotic target support platform is a vehicle adapted to operate over a ground surface in any direction.

3. The shooting training system of claim 1 wherein the self-propelled robotic target support platform is a watercraft.

4. The shooting training system of claim 1 wherein the self-propelled robotic target support platform is a wheeled vehicle.

5. The shooting training system of claim 1 wherein the sensor array is adapted to detect and register shot information including a location and direction of the shot.

6. The shooting training system of claim 1 including a plurality of robotic target support platforms, each having a sensor array.

7. The shooting training system of claim 1 wherein the receiver is adjacent to the shooter.

8. The shooting training system of claim 1 wherein the receiver includes a display screen visible to the shooter.

9. The shooting training system of claim 1 wherein the sensor array is adapted to detect a deviation of a shot from a desired target point.

10. The shooting training system of claim 1 wherein the motion of the platform is away from the shot to simulate running away from the shot.

11. The shooting training system of claim 1 wherein the motion is toward the shot to simulate charging towards the shot.

12. A method of shooting training comprising: providing a target-bearing mobile platform with a shot detection system adapted to navigate over an extended domain; operating the target-bearing mobile platform over the domain; a shooter shooting at the target; the shot detection system determining information about the shot, wherein the shot generated by the shooter and passing proximate the target, but not striking the target; a transmitter on the target-bearing mobile platform transmitting the information about the shot to a receiver associated with the shooter; operating a processor operably connected to the target-bearing mobile platform to generate motion of the target-bearing platform in response to the shot information, and the motion of the platform is in a direction based on the location of the shot.

13. The shooting training system of claim 12 including operating a controller on the target-bearing mobile platform to move the target-bearing mobile platform in response to the shot information.

14. The shooting training system of claim 12 wherein determining information about the shot includes determining a location and direction of the shot.

15. The shooting training system of claim 12 wherein determining information about the shot includes operating a plurality of acoustic sensors on the target-bearing mobile platform.

16. The shooting training system of claim 12 including operating the receiver to display the information about the shot to the shooter.

17. The shooting training system of claim 12 wherein the target-bearing mobile platform is a vehicle adapted to operate over a ground surface in any direction.

18. The shooting training system of claim 12 including an operating a plurality of robotic target support platforms, each having a sensor array.

19. The shooting training system of claim 12 including detecting a deviation of a shot from a desired target point.

20. A shooting training system comprising:

a self-propelled robotic target support platform operable to navigate on an extended surface;

the self-propelled robotic target support platform supporting a target;

the self-propelled robotic target support platform including a sensor array adapted to detect and register shot information about a shot generated by a shooter passing proximate the target;

a transmitter on the self-propelled robotic target support platform adapted to transmit the shot information;

a receiver associated with the shooter adapted to receive the shot information including a location of the shot and to provide shot information to the shooter; and including a processor operably connected to the self-propelled robotic target support platform and adapted to generate motion of the self-propelled robotic target support platform in response to the shot information and in a direction based on the location of the shot.

21. The shooting training system of claim 20 wherein the sensor array is adapted to detect and register shot information including a location and direction of the shot.

22. The shooting training system of claim 20 including a plurality of robotic target support platforms, each having a sensor array.

* * * * *